US006161709A

United States Patent [19]

Kluge et al.

[11] Patent Number: 6,161,709

[45] Date of Patent: Dec. 19, 2000

[54] SUSPENDED SHELF MOUNTING SYSTEM

[75] Inventors: Richard G. Kluge, Lake Geneva, Wis.; John R. Sterling, Woodstock, Ill.; William H. Trimble, Lawrenceville, Ga.

[73] Assignee: John Sterling Corporation, Richmond, Ill.

[21] Appl. No.: 09/373,949

[22] Filed: Aug. 13, 1999

[51] Int. Cl.[7] ..... A47F 5/08

[52] U.S. Cl. ..... 211/117; 211/90.01; 248/243; 108/107; 108/187

[58] Field of Search ..... 211/90.01, 117, 211/90.02, 90.04; 52/39; 108/107, 109, 187, 42; 248/250, 235, 243, 245

[56] References Cited

U.S. PATENT DOCUMENTS

| | | | |
|---|---|---|---|
| 325,767 | 9/1885 | Prior . | |
| 566,544 | 8/1896 | Smith . | |
| 946,337 | 1/1910 | Clear | 211/90.01 |
| 1,366,321 | 1/1921 | Kahn . | |
| 1,566,551 | 12/1925 | Ghrand . | |
| 1,592,840 | 7/1926 | Smalley . | |
| 2,238,003 | 4/1941 | Wilkinson . | |
| 2,933,196 | 4/1960 | Childs | 248/243 |
| 3,015,466 | 1/1962 | Levy . | |
| 3,184,068 | 5/1965 | Wende . | |
| 3,273,720 | 9/1966 | Seiz | 248/243 |
| 3,517,623 | 6/1970 | Goldstein et al. | 108/187 |
| 3,565,264 | 2/1971 | Guiher | 211/177 |
| 3,631,821 | 1/1972 | Zachariou . | |
| 3,885,675 | 5/1975 | Hultenby et al. . | |
| 3,933,102 | 1/1976 | Brunette | 248/250 |
| 4,138,019 | 2/1979 | Smith . | |
| 4,796,541 | 1/1989 | Halstrick | 108/107 |
| 4,973,110 | 11/1990 | Nyquist | 108/187 |
| 5,110,080 | 5/1992 | Rieman . | |
| 5,174,200 | 12/1992 | Jeandel et al. | 108/187 |
| 5,185,971 | 2/1993 | Johnson . | |
| 5,199,585 | 4/1993 | Schäfer | 108/107 |
| 5,350,074 | 9/1994 | Rosenband | 211/192 |
| 5,485,932 | 1/1996 | Romm et al. . | |
| 5,553,549 | 9/1996 | Nilsson | 108/193 |
| 5,779,068 | 7/1998 | Whiten et al. | 211/117 |
| 5,797,502 | 8/1998 | Brady et al. | 108/107 |
| 5,899,035 | 5/1999 | Waalkes et al. | 248/245 |
| 6,079,173 | 6/2000 | Waalkes et al. | 248/245 |

*Primary Examiner*—Ramon O. Ramirez
*Assistant Examiner*—Jon Szumny
*Attorney, Agent, or Firm*—Rockey, Milnamow & Katz, Ltd.

[57] ABSTRACT

A suspended shelf system for suspending one or more shelf members beneath an associated supporting structure includes a pair of shelf support brackets, and first and second pairs of vertically oriented upright elements which are each suspended from a respective end of one of the upper support brackets. Each support bracket includes at least one pair of upwardly extending teeth which are respectively positionable in openings defined by the upright elements. The shelf mounting system further includes at least one pair of shelf support brackets which respectively extend between the first and second pairs of upright elements in spaced apart, parallel relationship. Each of the shelf support brackets includes at least one pair of downwardly extending teeth, which are configured for cooperative engagement with the opening defined by the upright elements. Notably, the upper support brackets and shelf support brackets of the present shelf mounting system are preferably identically configured, with the shelf support brackets being oriented in an inverted orientation in comparison to the upper support brackets.

14 Claims, 3 Drawing Sheets

SUSPENDED SHELF MOUNTING SYSTEM

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates generally to a suspended shelf mounting system configured for suspending one or more shelves beneath associated supporting rafters or the like. More particularly, the present invention is directed to a shelf mounting system which includes identically configured upper support brackets and shelf support brackets, provided in the form of an invertible support bracket, which facilitates economical manufacture of the system, and efficient and convenient assembly.

BACKGROUND OF THE INVENTION AND TECHNICAL PROBLEMS POSED BY THE PRIOR ART

Typical shelving arrangements comprise assemblies of horizontal shelf members and vertical upright members which support the shelf members in vertically spaced, parallel relationship. While "built-in" shelving assemblies are well-known, shelving assemblies which can be readily installed by homeowners and other nonprofessionals have become increasingly popular. Of course, it is important that a such shelving assembly be convenient to install, while still providing stable and secure storage for articles placed on the assembly. Economical manufacture is highly desirable to promote affordable use by consumers.

Typical shelving assemblies known heretofore have included variously configured components which must be properly assembled to achieve the desired stability for the resultant construction. Use of fastening components and the like may be required, although such use may typically complicate assembly. Because such arrangements typically employ differently configured components, manufacturers and suppliers must supply and stock the various components for end-users, and the end-users must be sufficiently adept at assembly in order to properly integrate the components.

The present shelf mounting system is particularly configured for suspended mounting beneath an associated supporting structure, such as rafters or the like. Notably, the system employs a plurality of invertible support brackets, which are preferably identically configured, thus facilitating convenient and efficient assembly, and minimizing the number of different components required, for cost-effective manufacture and supply to consumers. When assembled with associated upright elements, the support brackets of the system provide a highly stable "self-locking" action which tends to enhance interengagement of the components attendant to use of the assembly for storage of articles.

BRIEF SUMMARY OF THE INVENTION

A suspended shelf mounting system embodying the principles of the present invention includes a pair of upper support brackets, first and second parallel pairs of vertically oriented upright elements, and at least one pair of shelf support brackets, all of which can be conveniently assembled in interengaging relationship with each other to form the present shelf mounting system. One or more horizontal shelf members can be positioned to respectively extend between each pair of shelf support brackets, with the upper support brackets being particularly configured for convenient mounting to an associated supporting structure, such as rafters or the like. Notably, the upper support brackets and shelf support brackets are preferably identically configured, in the form of an invertible support bracket, thus facilitating cost-effective manufacture and use, and convenient assembly by consumers.

In accordance with the illustrated embodiment, the present shelf mounting system includes a pair of upper support brackets positionable in spaced apart, parallel relationship. Each of the upper support brackets comprises an elongated body portion having a generally U-shaped, cross-sectional configuration, including a pair of parallel side walls extending from respective opposite edges of a central wall. Interengagement of the brackets with the associated upright elements is facilitated by the provision of a pair of laterally spaced, upwardly extending teeth at each end of the body portion of each bracket. The teeth extend respectively from the parallel side walls of the body portion, and each define an upwardly open notch with the respective one of the side walls. In accordance with the preferred form, each of the notches is generally wedge-shaped, which desirably promotes a self-locking action when the system is assembled, thus promoting secure and stable use of the assembly.

The present system further includes first and second parallel pairs of vertically oriented, upright elements. Each of the upright elements has a generally U-shaped cross-sectional configuration, including a pair of leg portions extending from respective opposite edges of a central web portion.

Interengagement of each upright element with the teeth of the support brackets is effected by the provision of first and second parallel rows of vertically spaced openings, preferably each configured as a slot. Each of the upright elements is suspended from a respective end of one of the pair of upper support brackets by disposition of the respective pair of laterally spaced, upwardly extending teeth in laterally aligned ones of the openings in the first and second rows of the respective upright element. In the illustrated embodiment, each of the support brackets includes first and second pairs of laterally spaced teeth, with each pair of teeth being respectively positionable in first and second laterally aligned pairs of openings in the respective upright element. Interengagement is achieved by insertion of the teeth into the slot-like openings in the upright elements, followed by relative vertical movement whereby each upright element is urged into snug, stable-fitting relationship with the wedge-shaped notches of the support brackets.

The present shelf mounting system further includes a pair of shelf support brackets respectively extending between the first pair of upright elements and the second pair of upright elements in spaced, parallel relationship. Each of the shelf support brackets comprises an elongated body portion having a generally U-shaped cross-sectional configuration, including a pair of parallel side walls extending from respective opposite edges of a central wall.

Each of the shelf support brackets includes a pair of laterally spaced, downwardly extending teeth at each end of the body portion of the shelf support bracket. The downwardly extending teeth of each pair extend respectively from the parallel side walls of the shelf support bracket, with each tooth defining a downwardly open notch with the respective one of the side walls.

Each of the shelf support brackets is supported by the respective pair of upright elements, in respective vertically spaced relationship beneath the upper support brackets. This is achieved by disposition of the laterally spaced pair of teeth at each end of the body portion in laterally aligned ones of the openings in the first and second rows of the respective upright element. In the illustrated embodiment, first and second pairs of the teeth are provided at each end of each shelf support bracket, with the teeth respectively positionable in first and second pairs of laterally aligned ones of the openings in the rows of openings in each upright element.

As noted, it is preferred that the upper support brackets and shelf support brackets of the present system are all of identical configuration, thus promoting efficient manufacture and convenient assembly. As will be appreciated, the provision of the upper support brackets with upwardly extending teeth, and the provision of the shelf support brackets with downwardly extending teeth provides the present system with a self-locking or self-engaging action. Objects placed on shelf members extending between and supported by the shelf support brackets tend to urge the shelf support brackets downwardly into locking interengagement with the associated upright elements, which in turn, are urged downwardly into locking engagement with the upwardly open notches defined by the upwardly extending teeth of the upper support brackets.

Assembly is further promoted by the provision of suitable openings for receiving associated mechanical fasteners. The body portion of each of the upper support brackets includes a pair of flanges respectively extending from the pair of side walls thereof, with each of the flanges defining a plurality of fastener-receiving openings. In use, the flanges are positioned along the upper extent of each upper support bracket, with the fastener-receiving openings defined by the flanges thus facilitating securement of the upper support brackets to associated supporting rafters or a like supporting structure.

It can also be desirable to secure the associated shelf members to the shelf mounting system. To this end, the central wall of the body portion of each of the shelf support brackets defines a plurality of fastener-receiving openings. The central wall of each shelf support bracket defines the upper extent thereof during use, with mechanical fasteners thus being invertible through the openings in the central wall, generally from within the U-shaped support bracket, so that the fasteners extend into and associated shelf member secured in position atop the shelf support brackets.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the components of this invention is described in the normal installed position, and terms such as upper, lower, horizontal, etc., are used with reference to this position. It will be understood, however, that the components of this invention may be manufactured, stored, transported, and sold in an orientation other than the position described.

Figure 1:
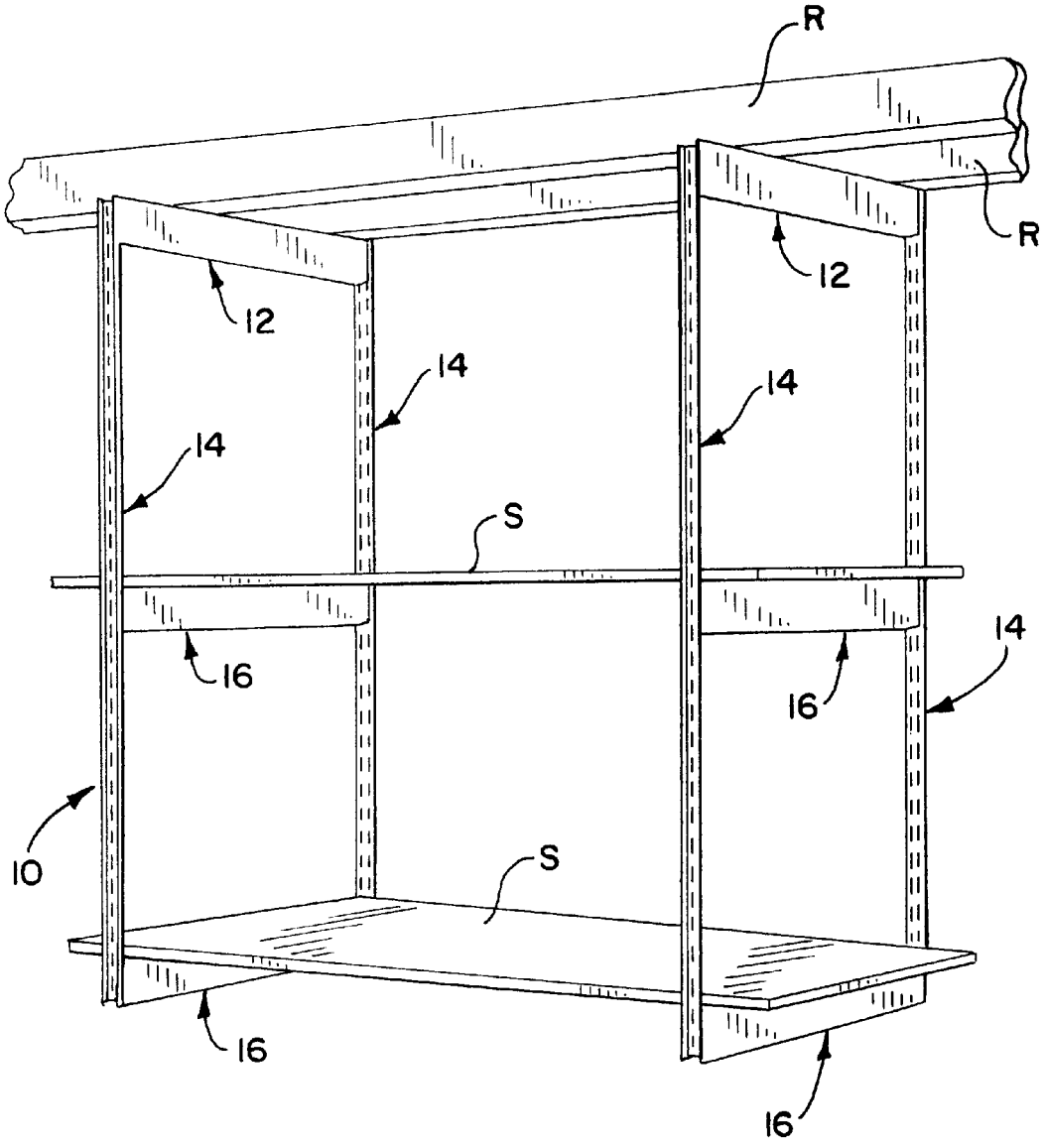
FIG. 1 is a perspective view of a shelving assembly including a suspended shelf mounting system embodying the principles of the present invention.
Figure 2:
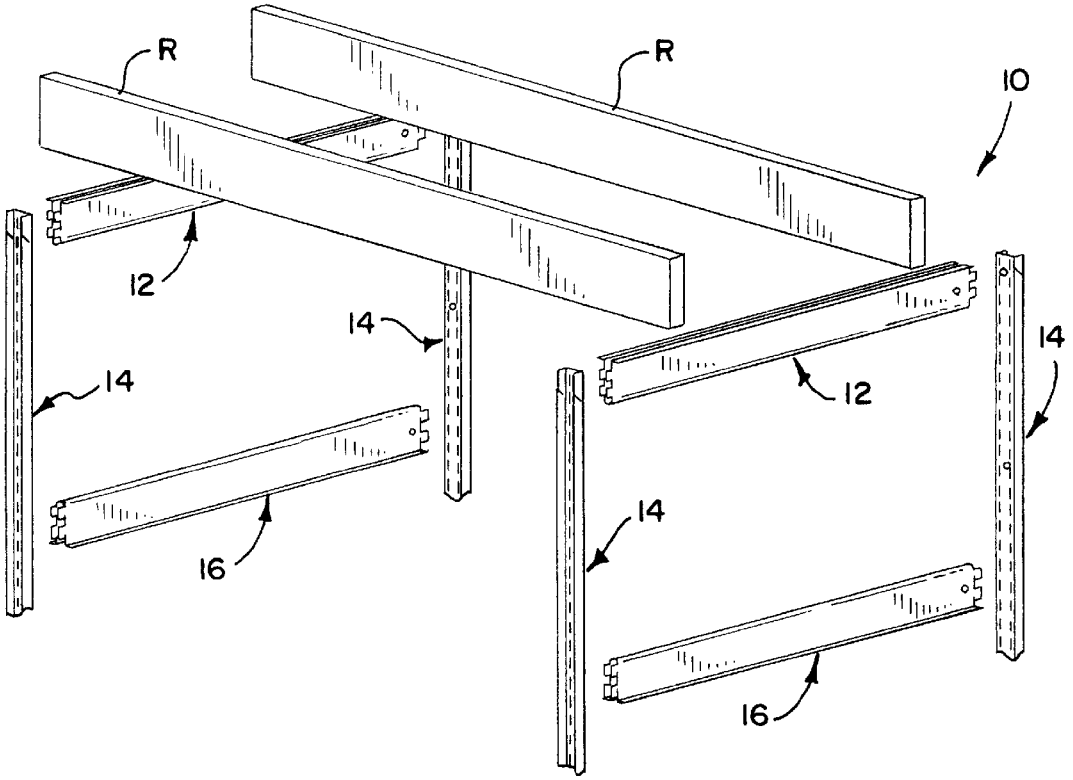
FIG. 2 is a fragmentary, exploded perspective view of the shelf mounting system illustrated in FIG. 1.

With reference to the drawings, therein is illustrated a suspended shelf mounting system 10 embodying the principles of the present invention. Shelf mounting system 10 is particularly configured for suspended support from an associated supporting structure, such as rafters R illustrated in FIG. 1. As will be appreciated, the present shelf mounting system can be suspended from other suitable supporting structures, such as from a ceiling or the like. The shelf mounting system is configured to receive one or more horizontal shelf members S, with two such shelf members being illustrated in FIG. 1. As will be appreciated, the number of shelf members S which can be mounted upon the present system can be varied by assembling the proper number of components, as may be desired.

The present shelf mounting system includes a pair of upper support brackets 12 positionable in spaced apart, parallel relationship. The upper support brackets are configured for securement to the associated rafters R or other supporting structure, by the use of suitable mechanical fasteners, as will be further described. The present shelf mounting system further includes first and second parallel pairs of vertically oriented upright elements 14 which each extend downwardly from a respective end of one of the upper support brackets 12. The present shelf mounting system further includes at least one pair of shelf support brackets 16 which respectively extend between the first pair of upright elements 14 and the second pair of upright elements 14 in spaced apart parallel relationship. As will be appreciated, one pair of shelf support brackets 16 is provided for each of the shelf members S to be mounted on the present system, with the embodiment illustrated in FIG. 1 being configured for supporting two shelf members S. By appropriate dimensioning of the upright elements 14, and the provision of an appropriate number of pairs of the shelf support brackets 16, the present mounting system can be configured for mounting of varying numbers of the shelf members.

Figure 3:
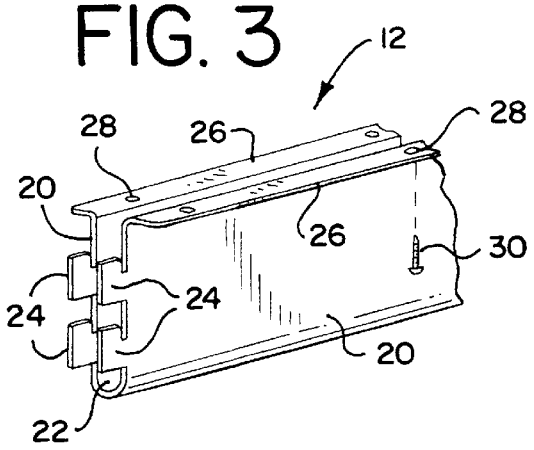
FIG. 3 is an enlarged, fragmentary view of one end of an upper support bracket of the present shelf mounting system.
Figure 4:
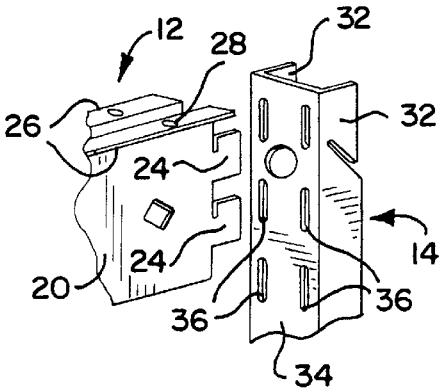
FIG. 4 is an enlarged, fragmentary view illustrating one end of an upper support bracket, and an associated upright element, of the present shelf mounting system.

With particular reference to FIGS. 3 and 4, the preferred configuration of each of the upper support brackets 12 will now be described. Each of the shelf members 12 includes an elongated body portion having a generally U-shaped, cross-sectional configuration, including a pair of parallel side walls 20 which extend from respective opposite sides of a central wall 22. Releasable interengagement with the associated upright elements 14 is achieved by the provision of at least one pair of laterally spaced, upwardly extending teeth 24, which extend respectively from the side walls 20 of the support bracket 12. In the illustrated embodiment, first and second pairs of the laterally spaced teeth 24 are provided, with each of the teeth being insertable into a respective slot-like opening defined by a respective one of the upright members 14, as will be further described. Each tooth defines, together with its respective side wall 20, an upwardly open notch, preferably having a wedge-shaped configuration to promote secure and stable interengagement with the associated upright element.

The present shelf mounting system is suspended from the associated rafters R by securement of the upper support bracket 12 to the rafters. To this end, each of the support brackets 12 preferably includes a pair of flanges 26 respectively extending from the side walls 20 of the support bracket 12. The flanges 26 preferably each define a plurality of fastener-receiving openings 28, each configured to receive an associated mechanical fastener 30 for securement of each upper support bracket to the associated supporting structure. The fastener-receiving openings 28 are preferably formed at preselected spacing corresponding to typical spacing of building rafters or ceiling joists, such as 12-inch-on-center spacing, 18-inch-on-center spacing, etc.

With particular reference to FIG. 4, the configuration of each of the upright elements 14 will now be described. Each of the upright elements 14 preferably has a generally U-shaped cross-sectional configuration, including a pair of leg portions 32 extending from respective opposite edges of a central web portion 34. Each of the upright elements is provided with a plurality of vertically spaced openings, which in the preferred form, are provided in the form of first and second rows of vertically spaced openings 36, each having a slotted configuration. The openings 36 extend through the central web 34 of each upright element, and are dimensioned to receive a respective one of the teeth 24 of the upper support brackets 12. As will be appreciated, each laterally spaced pair of the teeth 24 are insertable into a respective laterally aligned pair of the openings 36 in the first and second rows of openings, with the preferred configuration including first and second pairs of teeth 24 being configured for disposition within first and second laterally aligned pairs of the openings 36.

Assembly of the upright elements to the upper support brackets 12 is straightforward, and can be achieved without the use of associated fasteners. After mounting of the upper support brackets 12 on the associated rafters or other supporting structure, each of the upright elements 14 is moved toward a respective end of one of the support brackets 12, with the leg portions 32 of the upright element extending outwardly or away from the respective support bracket. The first and second pairs of teeth 24 are respectively received in the first and second laterally aligned pairs of openings 36, with it ordinarily being desirable to position the pairs of teeth 24 in the uppermost pairs of openings 36. After the upright element has been moved toward the support brackets such that the teeth 24 are inserted through the respective openings 36, the upright element 14 is moved relatively downwardly so that the central web portion 34 becomes fully seated within the upwardly open notches defined by the teeth 24. The preferred wedge-shaped configuration of each of the notches assures secure interengagement, with the upwardly open orientation of the notches tending to enhance interengagement under the influence of gravity as articles are placed upon the shelf assembly.

The shelf support brackets 16 of the present system will now be described. As noted, it is particularly preferred that the shelf support brackets 16 be identical in configuration to the upper support brackets 12, with the shelf support brackets 16 being assembled in an orientation which is inverted, in comparison to the upper support brackets 12. The provision of identically configured upper support brackets 12 and shelf support brackets 16 enhances cost-effective use of the present shelf-mounting system, and facilitates convenient assembly by consumers, since the number of differing components is minimized.

Figure 5:
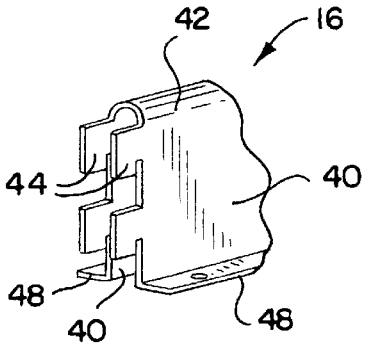
FIG. 5 is an enlarged, fragmentary view illustrating one end of a shelf support bracket of the present shelf mounting system.
Figure 6:
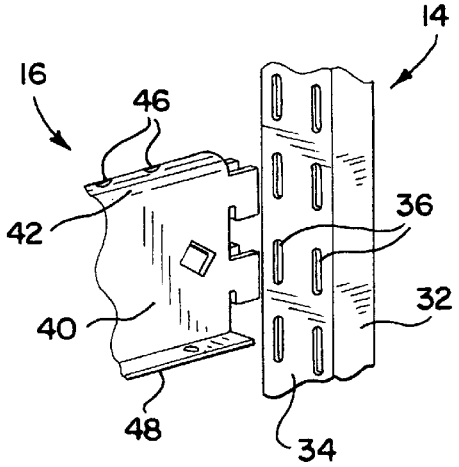
FIG. 6 is an enlarged, fragmentary view illustrating an end of a shelf mounting bracket and an associated upright element of the present shelf mounting system.
Figure 7:
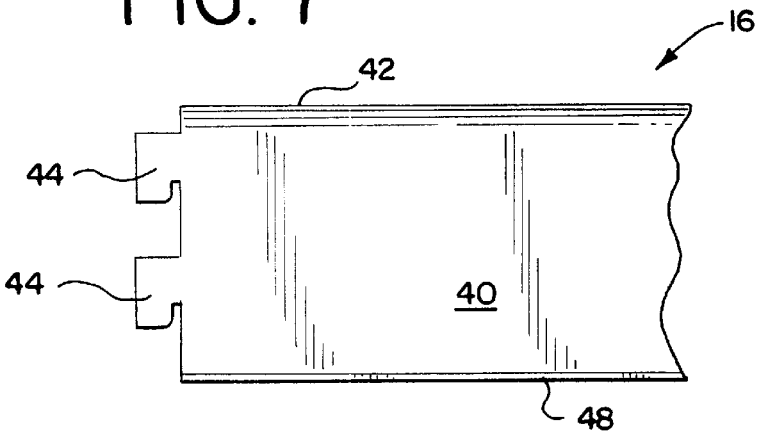
FIG. 7 is a fragmentary, side elevational view of a shelf support bracket of the present system.
Figure 8:
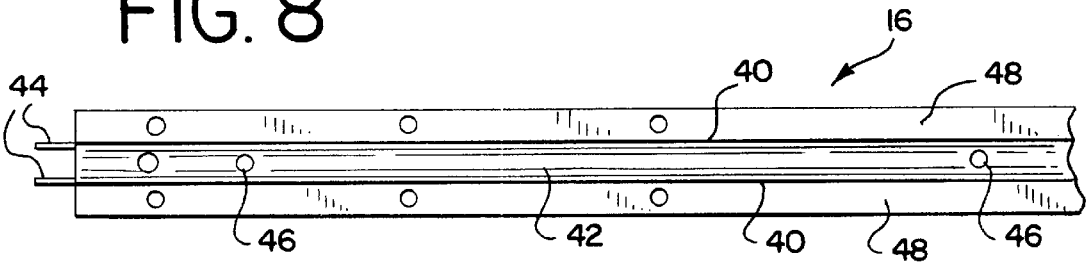
FIG. 8 is a fragmentary, top plan view of a shelf support bracket of the present shelf mounting system.

With particular reference to FIGS. 5 and 6, each of the shelf support brackets 16 includes an elongated body portion having a generally U-shaped, cross-sectional configuration, including a pair of parallel side walls 40 which extend from respective opposite edges of a central wall 42. Cooperative interengagement of the shelf support brackets 16 with the associated upright elements 14 is achieved by the provision of at least one pair of laterally spaced, downwardly extending teeth 44 which extend respectively from the side walls 40 of the shelf support bracket. In accordance with the preferred form, first and second pairs of the laterally spaced teeth 40 are provided for respective insertion into first and second laterally aligned pairs of the openings 36 provided in the first and second rows of openings in each upright element 14. Each of the teeth 44 defines, together with its respective side wall 40, a downwardly opening notch, each preferably having a wedge-shaped configuration. FIG. 7 illustrates the wedge-shaped configuration of the notches defined by teeth 44, with the understanding that the notches defined by teeth 24 of the upper support brackets 12 are preferably similarly configured.

Each of the shelf support brackets 16 includes a pair of flanges 48 respectively extending from the pair of side walls 40. In order to permit the associated shelf members S to be secured to each respective pair of shelf support brackets 16, the central wall 42 of each shelf support bracket preferably defines a plurality of fastener-receiving openings 46. Associated mechanical fasteners (not shown) can be inserted through a respective one of the openings 46 by disposition between the side walls 40 of the bracket, with each fastener thereafter inserted into the lower surface of the associated shelf member S.

The assembly of the shelf support brackets 16 with the associated upright elements 14 can be readily achieved without the use of tools by insertion of the first and second pairs of teeth 44 into respective pairs of the laterally aligned openings 36 in the respective upright element 14. After insertion of the teeth 44 into the openings 36, the shelf support brackets 16 can be moved downwardly relative to the upright element, so that the central web portion 34 of the upright element becomes fully seated within the downwardly open notches defined by the teeth 44. As will be appreciated, a self-locking or self-engaging action is achieved, under the influence of gravity, as articles placed on the shelf members S tend to urge the shelf support brackets downwardly, thus enhancing engagement of the upright elements 14 with the downwardly open notches of the shelf support brackets.

Shelf support brackets 16 can be selectively positioned along the length of each of the upright elements 14 so that the teeth 44 of the brackets are positioned in corresponding ones of the openings 36 in the upright elements. By merely reversing the steps taken for assembly of the shelf support brackets with the upright elements 14, the shelf members can be easily repositioned on the shelf mounting system, as may be desired. By use of the appropriate number of pairs of the shelf support bracket 16, the number of shelf members carried by the system can be selectively varied, thus enhancing versatile use of the present system.

It will be readily apparent from the foregoing detailed description of the invention and from the illustrations thereof that numerous variations and modifications may be effected without departing from the true spirit and scope of the novel concepts or principles of this invention.

What is claimed is:

1. A suspended shelf mounting system, comprising:

a pair of upper support brackets positionable in spaced, apart, parallel relationship, each of said upper support brackets comprising an elongated body portion including a central web portion and at least one side wall extending from a respective edge of said web portion, and at least one upwardly extending tooth at each end of said body portion extending integrally from and being planarly aligned with said at least one side wall, each of said teeth defining a respective upwardly open notch with the side wall of the body portion;

first and second parallel pairs of vertically oriented upright elements, each of said upright elements defining a plurality of vertically spaced openings, each of said upright elements being suspended from a respective end of one of said pairs of upper support brackets by disposition of said at least one upwardly extending tooth in one of said spaced openings of the respective upright element; and a pair of shelf support brackets respectively extending between said first pair of upright elements and said second pair of upright elements in spaced apart, parallel relationship, each of said shelf support brackets comprising an elongated body portion including a central web portion and at least one side wall extending from a respective edge of said web portion, and at least one downwardly extending tooth at each end of said body portion extending integrally from and being planarly aligned with said at least one side wall, each of said teeth of said shelf support brackets defining a respective downwardly open notch with the side wall of the body portion of the shelf support bracket;

each of said shelf support brackets being supported by the respective pair of said upright elements, in respective vertically spaced relationship beneath said upper support brackets, by disposition of said at least one downwardly extending tooth at each end of said body portion in another one of said spaced openings of the respective upright element.

2. The suspended shelf mounting system in accordance with claim 1, wherein said upper support brackets and said shelf support brackets are all of identical configuration.

3. The suspended shelf mounting system in accordance with claim 1, wherein each of said upwardly open notches and said downwardly open notches are generally wedge-shaped for enhancing engagement between said support brackets and said upright elements.

4. The suspended shelf mounting system in accordance with claim 1, wherein each of said upright elements has a generally U-shaped, cross-sectional configuration, including a pair of leg portions extending from respective opposite edges a central web portion, said web portion of each upright element defining said plurality of vertically spaced openings.

5. The suspended shelf mounting system in accordance with claim 4, wherein the web portion of each said upright element defines first and second parallel rows of said vertically spaced openings, each of said openings comprising a vertically oriented slot.

6. The suspended shelf mounting system in accordance with claim 5, wherein:

each of said upper support brackets has a pair of said side walls extending from respective opposite edges of said central web portion of the upper support bracket, and a pair of laterally spaced ones of said upwardly extending teeth at each end of the body portion of the upper support bracket respectively extending integrally from said side walls of said upper support bracket, the upwardly extending teeth of each laterally spaced pair being respectively disposed in laterally aligned ones of the openings in said first and second rows of the respective upright element.

7. The suspended shelf mounting system in accordance with claim 6, wherein:

each of said shelf support brackets has a pair of said side walls extending from respective opposite edges of said central web portion of the shelf support bracket, and a pair of laterally spaced ones of said downwardly extending teeth at each end of the shelf support bracket respectively extending integrally from said side walls of said shelf support bracket, the downwardly extending teeth of each laterally spaced pair being respectively disposed in laterally aligned ones of the openings in said first and second rows of openings of the respective upright element.

8. A suspended shelf mounting system, comprising:

a pair of upper support brackets positionable in spaced apart, parallel relationship;

each of said upper support brackets comprising an elongated body portion having a generally U-shaped cross-sectional configuration, including a pair of parallel side walls extending from respective opposite edges of a central wall, and a pair of laterally spaced, upwardly extending teeth at each end of said body portion, the teeth of said pair extending respectively from said parallel side walls and each defining an upwardly open notch with the respective one of said side walls;

first and second parallel pairs of vertically oriented upright elements, each of said upright elements having a generally U-shaped cross-sectional configuration, including a pair of leg portions extending from respective opposite edges of a central web portion;

the web portion of each said upright element defining first and second parallel rows of vertically spaced openings, each of said upright elements being suspended from a respective end of one of said pairs of upper support brackets by disposition of the respective pair of said laterally spaced upwardly extending teeth in laterally aligned ones of the openings in said first and second rows of the respective upright element; and a pair of shelf support brackets respectively extending between said first pair of upright elements and said second pair of upright elements in spaced apart parallel relationship;

each of said shelf support brackets comprising an elongated body portion having a generally U-shaped cross-sectional configuration, including a pair of parallel side walls extending from respective opposite edges of a central wall, and a pair of laterally spaced, downwardly extending teeth at each end of said body portion of the shelf support brackets, the downwardly extending teeth of each said pair extending respectively from said parallel side walls of the shelf support bracket and each tooth defining a downwardly open notch with the respective one of said side walls;

each of said shelf support brackets being supported by the respective pair of said upright elements, in respective vertically spaced relationship beneath said upper support brackets, by disposition of said laterally spaced pair of teeth at each end of said body portion in laterally aligned ones of the openings in said first and second rows of the respective upright element.

9. The suspended shelf mounting system in accordance with claim 8, wherein said upper support brackets and said shelf support brackets are all of identical configuration.

10. The suspended shelf mounting system in accordance with claim 8, wherein the body portion of each of said upper support brackets includes a pair of flanges respectively extending from said pair of side walls, each of said flanges defining a plurality of fastener-receiving openings.

11. The suspended shelf mounting system in accordance with claim 8, wherein the central wall of the body portion of each of said shelf support brackets defines a plurality of fastener-receiving openings.

12. An invertible support bracket for a shelf mounting system, said support bracket comprising:

an elongated body portion having a generally U-shaped cross-sectional configuration, including a pair of parallel side walls extending from respective opposite edges of a central web portion wherein each of said parallel side walls has an end opposite said central web portion, first and second pairs of laterally spaced teeth at each end of said body portion, the teeth of said pair extending respectively from said parallel side walls and each defining an open notch with the respective one of said side walls and a pair of flanges respectively extending perpendicularly in opposite directions from said ends of said side walls each of said flanges defining a plurality of fastener-receiving openings.

13. The invertible support bracket in accordance with claim 12, wherein:

said central wall of said body portion defines another plurality of fastener-receiving openings.

14. The invertible support bracket in accordance with claim 12, wherein said notches defined by said teeth and said side walls being generally wedge-shaped.

* * * * *